US011833375B2

(12) United States Patent
Grant

(10) Patent No.: US 11,833,375 B2
(45) Date of Patent: Dec. 5, 2023

(54) LIFELINE BYPASS SHUTTLE

(71) Applicant: Arlen Paul Grant, Stillwater, MN (US)

(72) Inventor: Arlen Paul Grant, Stillwater, MN (US)

(73) Assignee: Engineered Supply, Bayport, MN (US)

( * ) Notice: Subject to any disclaimer, the term of this patent is extended or adjusted under 35 U.S.C. 154(b) by 23 days.

(21) Appl. No.: 17/180,862

(22) Filed: Feb. 21, 2021

(65) Prior Publication Data

US 2021/0260417 A1 Aug. 26, 2021

Related U.S. Application Data

(60) Provisional application No. 62/980,119, filed on Feb. 21, 2020.

(51) Int. Cl.
*A62B 35/00* (2006.01)
*E04G 21/32* (2006.01)

(52) U.S. Cl.
CPC ..... *A62B 35/0056* (2013.01); *A62B 35/0068* (2013.01); *A62B 35/0087* (2013.01); *E04G 21/3276* (2013.01)

(58) Field of Classification Search
CPC ..... A62B 35/0056; A62B 35/0068; A62B 35/0087; A62B 35/0081; A62B 35/0062; A62B 35/0043; E04G 21/3295; E04G 21/3276
See application file for complete search history.

(56) References Cited

U.S. PATENT DOCUMENTS 4,790,410 A * 12/1988 Sharp ..... A62B 35/0056 182/12
5,224,427 A * 7/1993 Riches ..... A62B 35/0087 188/371
5,279,385 A * 1/1994 Riches ..... A62B 35/0087 182/36
6,474,442 B1 * 11/2002 Atkinson ..... A62B 35/0087 104/115
6,488,118 B1 * 12/2002 Corriveau ..... A62B 35/0056 104/111
6,604,605 B2 * 8/2003 Peterson ..... A62B 35/0087 182/36
7,207,414 B2 * 4/2007 Luke ..... A62B 35/04 182/45

(Continued)

FOREIGN PATENT DOCUMENTS

DE 102013021739 A1 * 6/2015 ..... A62B 35/0056
EP 3369460 A1 * 9/2018 ..... A62B 35/0056

(Continued)

*Primary Examiner* — Eret C McNichols
(74) *Attorney, Agent, or Firm* — Laabs Intellectual Property

(57) ABSTRACT

In some embodiments, a lifeline comprises an anchor arranged to support a cable and a shuttle arranged to move along a length of the cable. The anchor comprises a body portion and a cable engaging portion. The body portion comprises a thickness. The shuttle comprises a first end and a second end. A cavity extends from the first end to the second end and a slot extends from the first end to the second end. The cable extends through the cavity. A width of the slot is greater than the thickness of the body portion. The width of the slot is less than a cross-sectional size of the cable.

16 Claims, 10 Drawing Sheets

(56) References Cited

U.S. PATENT DOCUMENTS

| | | | | |
|---|---|---|---|---|
| 7,347,300 | B2 * | 3/2008 | Renton | A62B 35/0056 182/36 |
| 7,357,222 | B2 * | 4/2008 | Durbic | A62B 35/0056 188/375 |
| 7,946,539 | B2 * | 5/2011 | Lara | A62B 35/0056 248/65 |
| 8,001,904 | B2 * | 8/2011 | Maes | A62B 35/0087 104/115 |
| 8,869,934 | B2 * | 10/2014 | Bodnar | A62B 35/0056 182/36 |
| 9,186,530 | B2 * | 11/2015 | Jones | A62B 35/0087 |
| 9,504,861 | B2 * | 11/2016 | Jones | A62B 35/0081 |
| 10,201,720 | B2 * | 2/2019 | Jones | A62B 35/0087 |
| 10,420,967 | B2 * | 9/2019 | Poldmaa | E04G 21/3295 |
| 2010/0294590 | A1 * | 11/2010 | Bodnar | E04G 21/3204 182/36 |
| 2018/0154197 | A1 * | 6/2018 | Riches | A62B 35/0087 |
| 2020/0114182 | A1 * | 4/2020 | Sudeith | A62B 35/0018 |
| 2021/0128956 | A1 * | 5/2021 | Novotny | A62B 35/0056 |
| 2022/0152436 | A1 * | 5/2022 | Squire | A62B 1/14 |

FOREIGN PATENT DOCUMENTS

| | | | | | |
|---|---|---|---|---|---|
| EP | 3722539 | A1 | * | 10/2020 | A62B 35/005 |
| GB | 2336617 | A | * | 10/1999 | A62B 35/0056 |
| GB | 2351789 | A | * | 1/2001 | A62B 35/0056 |
| GB | 2370312 | A | * | 6/2002 | A62B 35/0056 |
| GB | 2388148 | A | * | 11/2003 | A62B 35/005 |
| WO | WO-2012164279 | A2 | * | 12/2012 | A62B 35/005 |

* cited by examiner

LIFELINE BYPASS SHUTTLE

CROSS-REFERENCE TO RELATED APPLICATIONS

This application claims the benefit of U.S. Patent Application No. 62/980,119, filed Feb. 21, 2020, the entire content of which is hereby incorporated herein by reference.

BACKGROUND OF THE INVENTION

This invention relates generally to lifeline and fall protection systems.

Lifeline system can be arranged to support a worker. A lifeline is typically anchored between fixed supports and the lifeline can only be traversed between the supports. Workers are often forced to disconnect from one lifeline and reconnect to another lifeline as they proceed along a building.

There remains a need for novel lifeline systems that provide benefits and ease of use over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a lifeline comprises an anchor arranged to support a cable and a shuttle arranged to move along a length of the cable. The anchor comprises a body portion and a cable engaging portion. The body portion comprises a thickness. The shuttle comprises a first end and a second end. A cavity extends from the first end to the second end and a slot extends from the first end to the second end. The cable extends through the cavity. A width of the slot is greater than the thickness of the body portion. The width of the slot is less than a cross-sectional size of the cable.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
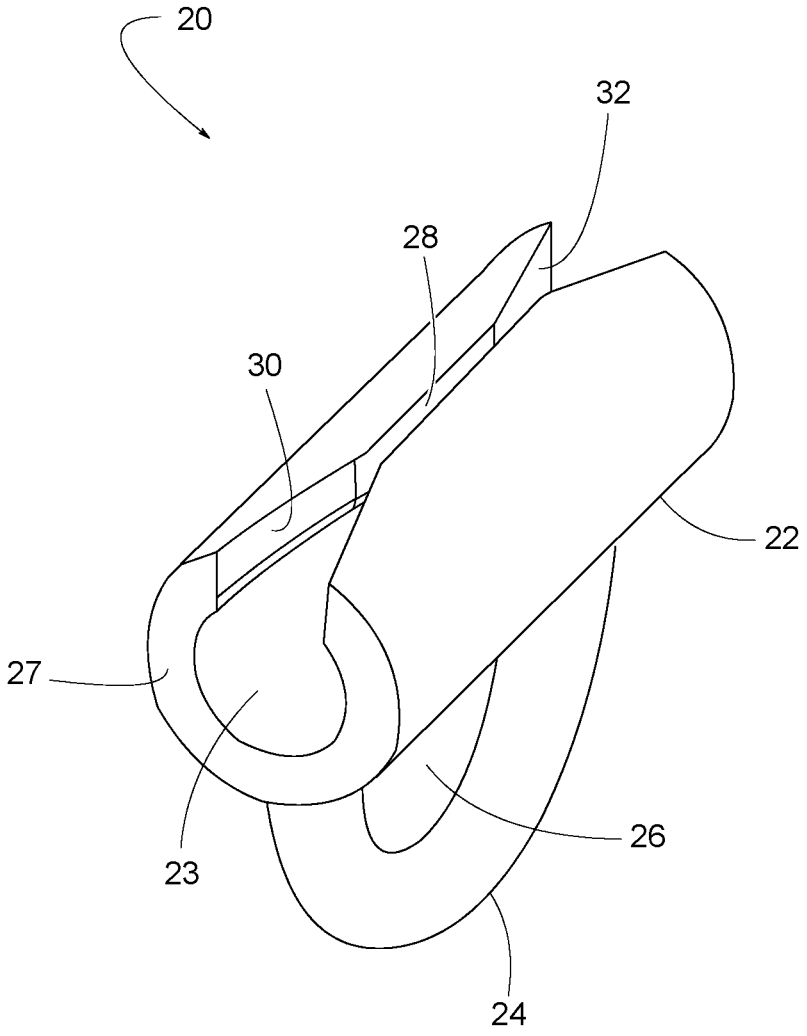
FIG. 1 shows an embodiment of a shuttle.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
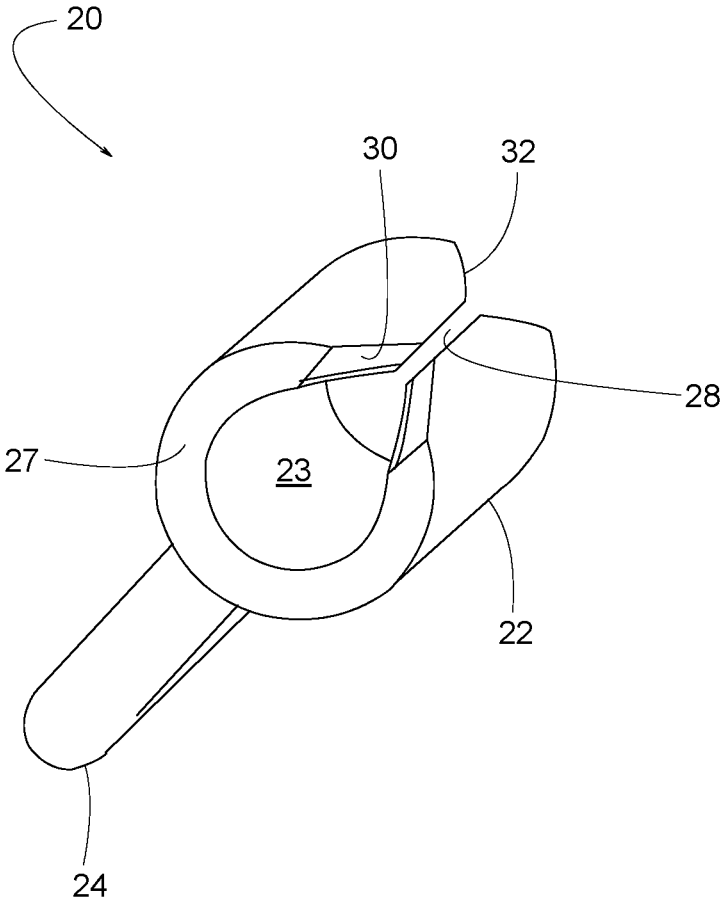
FIG. 2 shows another view of the embodiment of the shuttle shown in FIG. 1.
Figure 3:
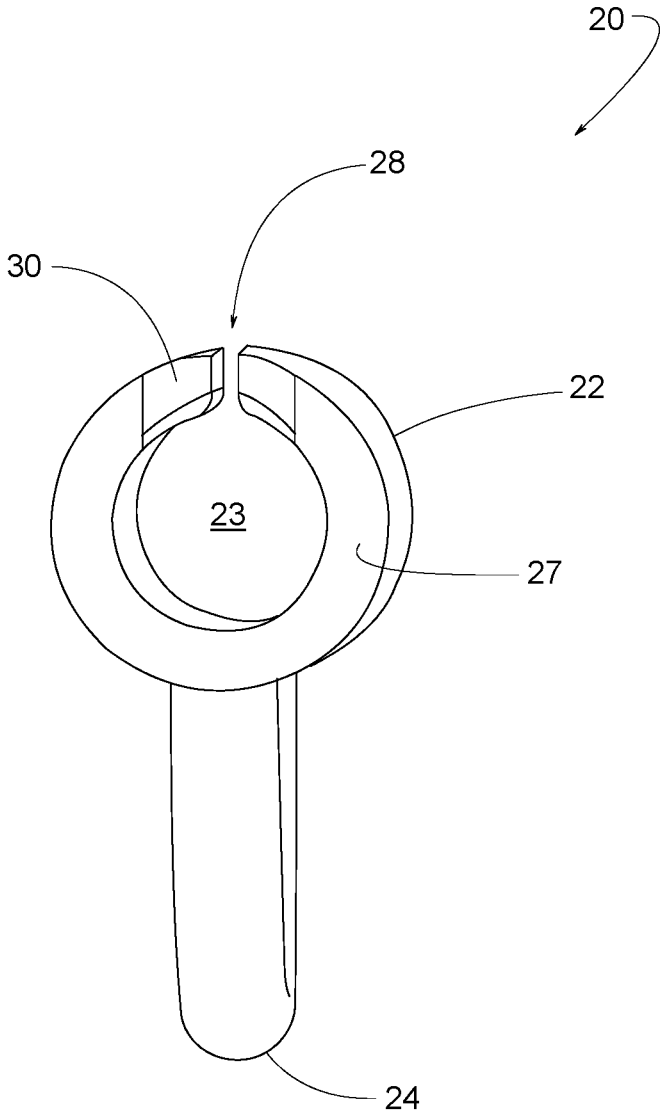
FIG. 3 shows another view of the embodiment of the shuttle shown in FIG. 1.

FIGS. 1-3 show an embodiment of a shuttle 20. In some embodiments, the shuttle 20 is suitable for use with a fall protection system, such as a horizontal lifeline system.

In some embodiments, a shuttle 20 comprises a body 22 that defines a cavity 23. In some embodiments, the body 22 comprises a sidewall 23 comprising a cylindrical shape. In some embodiments, the sidewall 23 extends about a central axis. In some embodiments, the shuttle 20 is arranged to be supported by a lifeline system, such as a cable. In some embodiments, a support cable will extend through the cavity 23, and the shuttle 20 can traverse along a length of the support cable.

In some embodiments, the shuttle 20 comprises an aperture 26. In some embodiments, the shuttle 20 comprises a hoop 24 that defines the aperture 26. In some embodiments, the aperture 26 allows for the connection of a safety line, such as a fall protection line arranged to catch a falling worker. Thus, a worker can connect a safety line to the shuttle 20, and the shuttle 20 can support the worker as the worker moves along a length of the support cable.

In some embodiments, the shuttle 20 comprises a slot 28 formed in the sidewall 27. In some embodiments, the slot 28 allows the shuttle 20 to move over an anchor structure that supports the support cable.

In some embodiments, the slot 28 extends for an entire length of the body 22. In some embodiments, a central length portion of the slot 28 comprises the narrowest portion of the slot 28. In some embodiments, a width of the slot 28 (e.g. distance across the slot 28) is less than a distance across the support cable. In some embodiments, a width of the slot 28 is less than a diameter of the support cable. Thus, the support cable cannot pass through the slot 28, and the shuttle 20 will remain engaged with the support cable.

In some embodiments, a thickness of the sidewall 27 of the shuttle 20 is greater than the width of the slot 28.

In some embodiments, the slot 28 comprises a tapered portion 30. In some embodiments, a tapered portion 30 is located at an end of the slot 28. In some embodiments, the slot 28 comprises a second tapered portion 32. In some embodiments, a second tapered portion 32 is located at an end of the slot 28. In some embodiments, the tapered portions 30, 32 comprise flared end portions of the slot 28.

In some embodiments, the tapered portions 30, 32 can help guide a support anchor through the slot 28.

In some embodiments, the hoop 24 extends outwardly along a first radial vector. In some embodiments, the slot 28 is oriented along a second radial vector. In some embodiments, the first radial vector and the second radial vector face opposite directions and the slot 28 is opposite the hoop 24. In some embodiments, the first radial vector and the second radial vector are perpendicular. In some embodiments, the shuttle 20 can have any suitable angle between the first radial vector and the second radial vector. Thus, the hoop 24 can have any radial vector orientation with respect to the slot 28.

Figure 4:
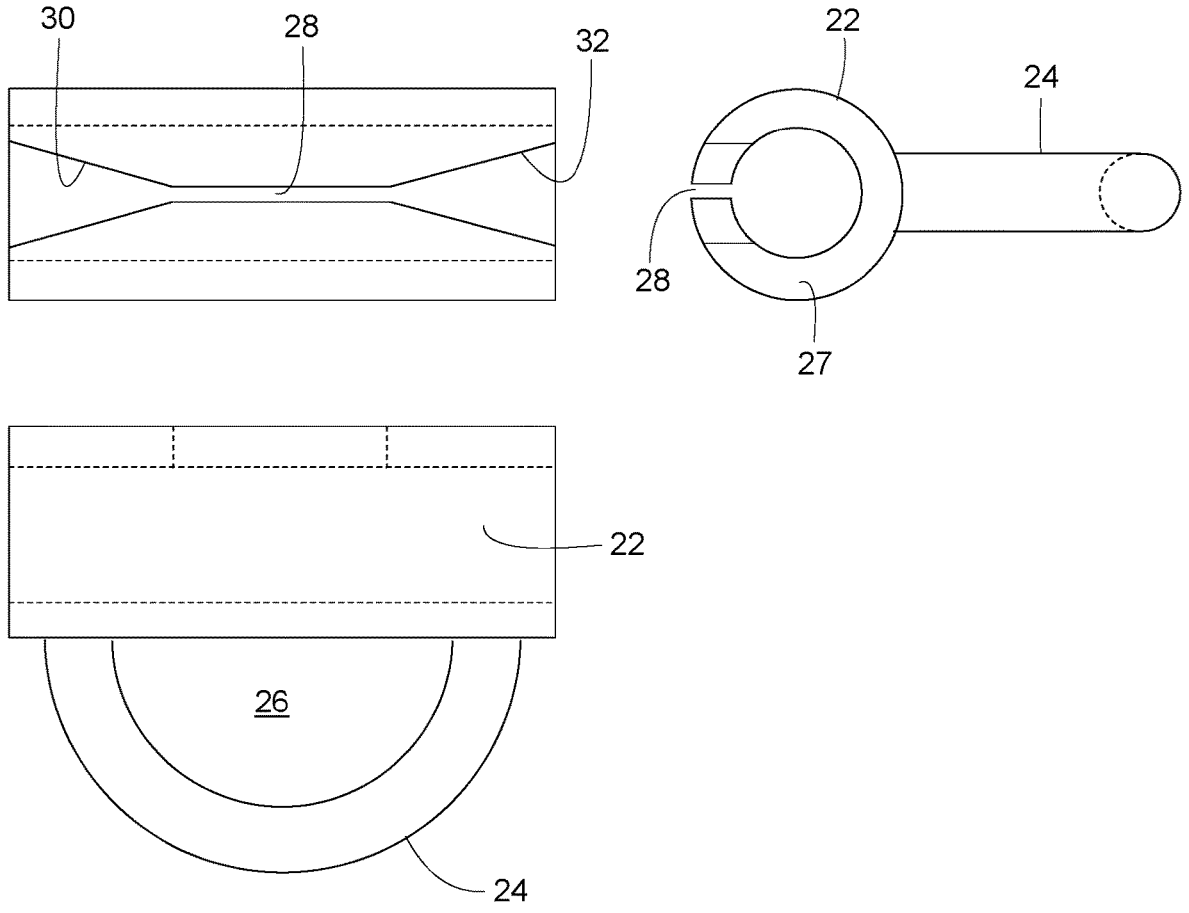
FIG. 4 shows an embodiment of a shuttle.

FIG. 4 shows views of an embodiment of a shuttle 20.

Figure 5:
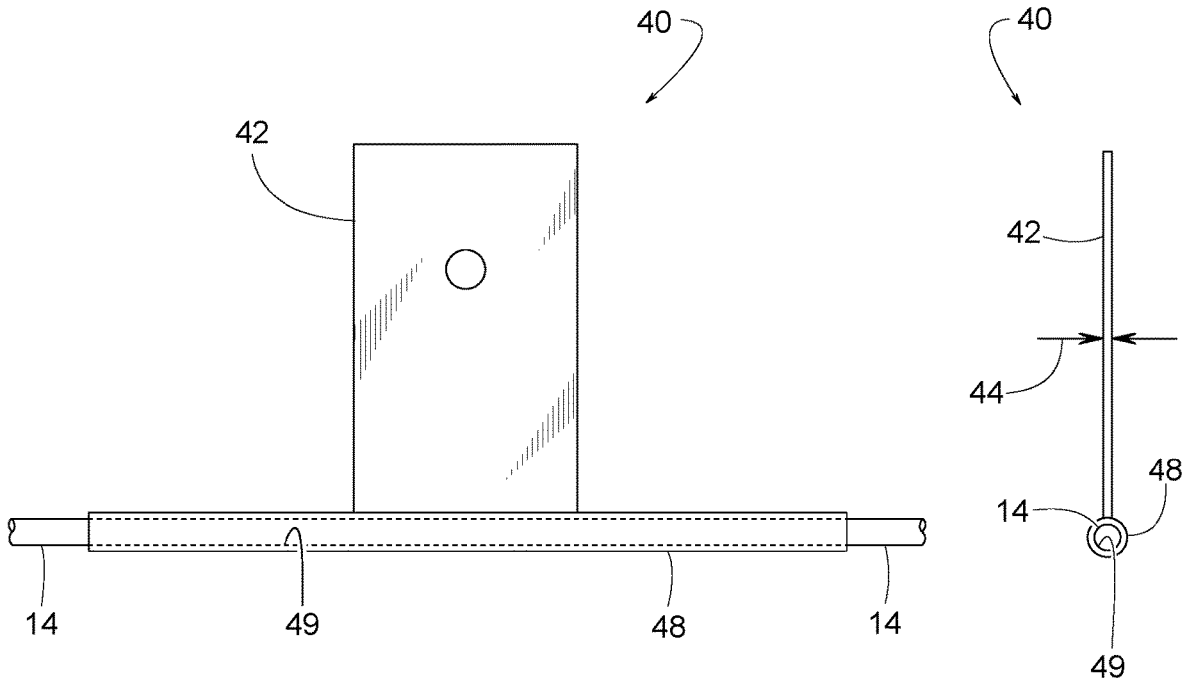
FIG. 5 shows an embodiment of a support anchor.

FIG. 5 shows an embodiment of an anchor 40. In some embodiments, an anchor 40 is supported by a permanent structure such as a building. In some embodiments, an anchor 40 supports a lifeline such as a cable 14. In some embodiments, the cable 14 supports a shuttle 20.

In some embodiments, an anchor 40 comprises a body portion 42 and a cable engaging portion 48. In some embodiments, the body portion 42 is configured for attachment to a supporting structure. In some embodiments, the body portion 42 comprises an aperture arranged to receive a support bolt. In some embodiments, the body portion comprises a plate. In some embodiments, the cable engaging portion 48 comprises a tube. In some embodiments, the tube 48 defines a cavity 49. In some embodiments, the cable 14 extends through the cavity 49.

In some embodiments, a shuttle 20 can pass over the anchor 40. In some embodiments, the tube 48 of the anchor 40 is arranged to pass through the cavity 23 defined by the body 22 of the shuttle 20. In some embodiments, a shuttle 20 supported by the cable 14 can pass from a first side of the anchor 40 to a second side of the anchor 40 without disengaging from the cable 14. Thus, in some embodiments, the shuttle 20 is arranged to bypass the anchor 40.

Desirably, a cross-sectional size of the tube 48 is less than a cross-sectional size of the cavity 23, allowing the tube 48 of the anchor 40 to pass through the cavity 23 of the shuttle 20.

Desirably, a width of the slot 28 in the shuttle 20 is greater than a thickness 44 of the body portion 42 of the anchor 40 directly adjacent to the cable engaging portion 48, allowing the body portion 42 to pass through the slot 28 of the shuttle 20.

Figure 6:
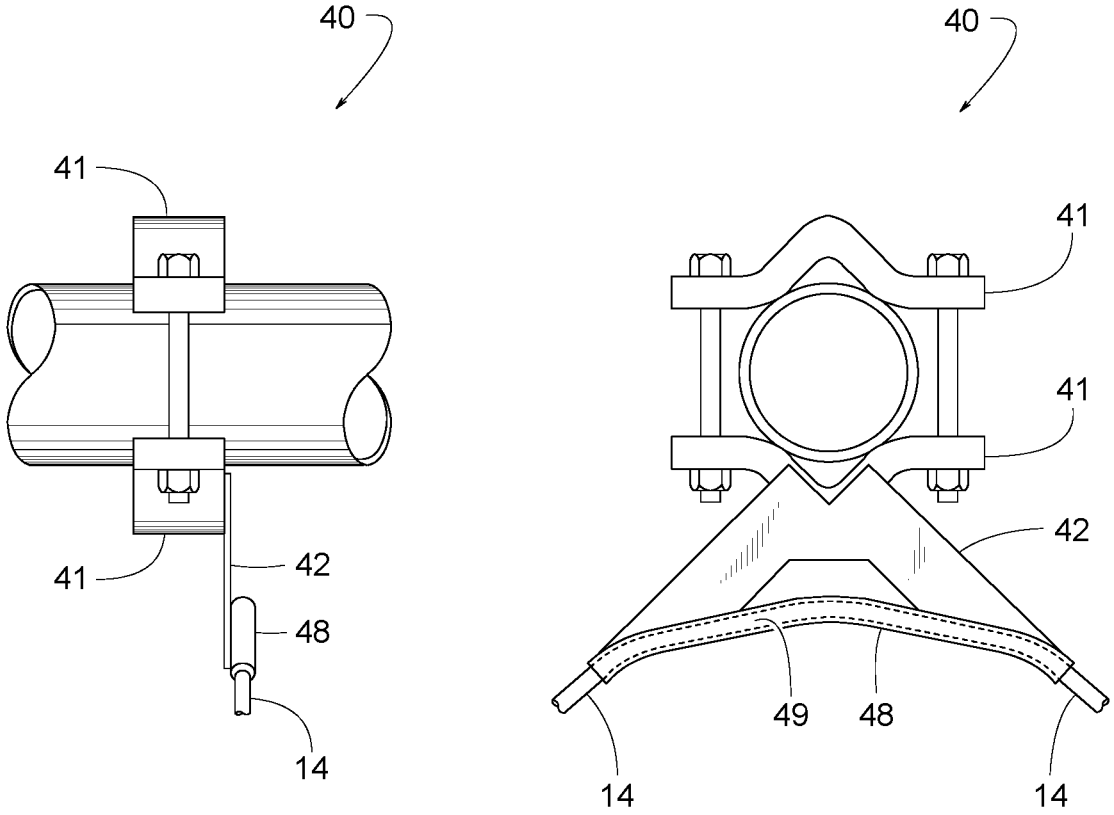
FIG. 6 shows another embodiment of a support anchor.

FIG. 6 shows another embodiment of an anchor 40. In some embodiments, a tube 48 comprises curvature along its length. In some embodiments, a cable 14 segment exiting one end of the anchor 40 is oriented at an angle to a cable 14 segment exiting the other end of the anchor 40. In some embodiments, an anchor 40 is arranged as a corner support for the cable 14.

In some embodiments, a support plate 42 is attached to a bracket 41 that is arranged to engage a support.

Desirably, the shuttle 20 is able to traverse the anchor 40, and the tube 48 is able to pass through the cavity 23 of the shuttle 20.

In some embodiments, a lifeline system comprises a plurality of anchors 40 and a cable 14 attached to each anchor 40. In some embodiments, the cable 14 supports a shuttle 20. In some embodiments, the cable 14 extends through the aperture 23 of the shuttle 20. In some embodiments, the shuttle 20 can pass across an anchor 40 without disengaging from the cable 14. In some embodiments, a lifeline system comprises several anchors 40 attached to a continuous cable 14, and a shuttle 20 capable of bypassing multiple anchors 40.

Figure 7:
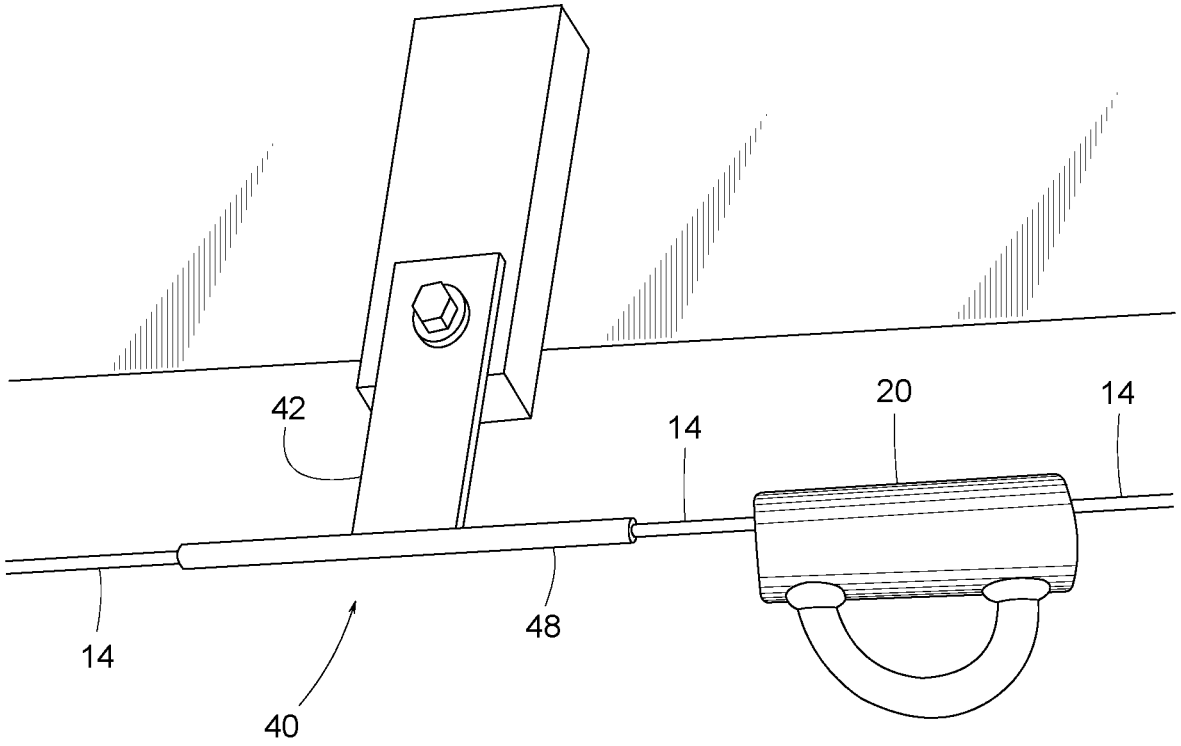
FIG. 7 shows an embodiment of a lifeline system.
Figure 8:
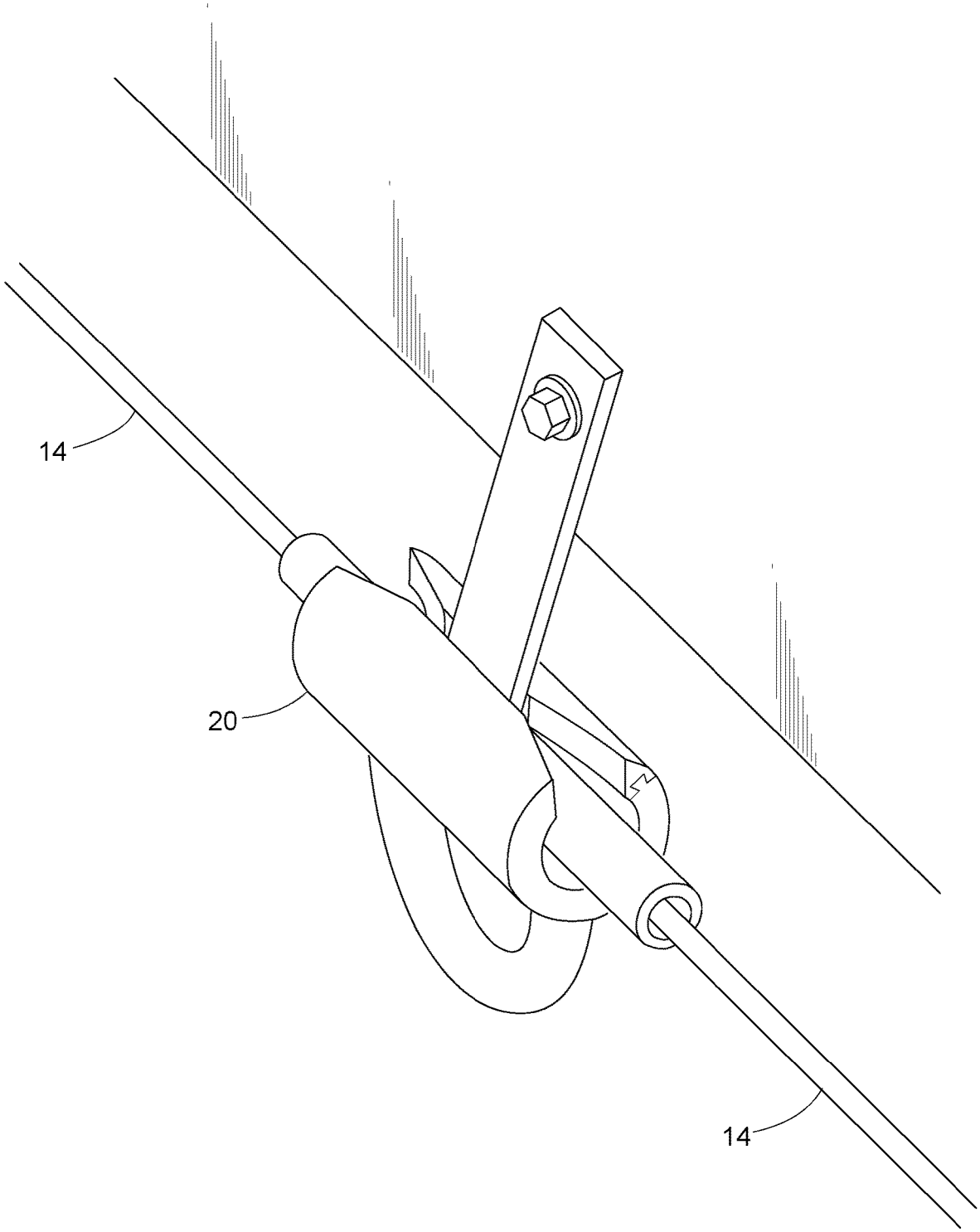
FIG. 8 shows an embodiment of a lifeline system.

FIGS. 7 and 8 show an embodiment of a lifeline system comprising an anchor 40 arranged to support a cable 14 and an embodiment of a shuttle 20 supported by the cable 14. The shuttle 20 is able to pass from a first side of the anchor 40 to a second side. A worker's safety line can remain engaged to the shuttle 20 continuously as the shuttle 20 moves across the anchor 40.

Figure 9:
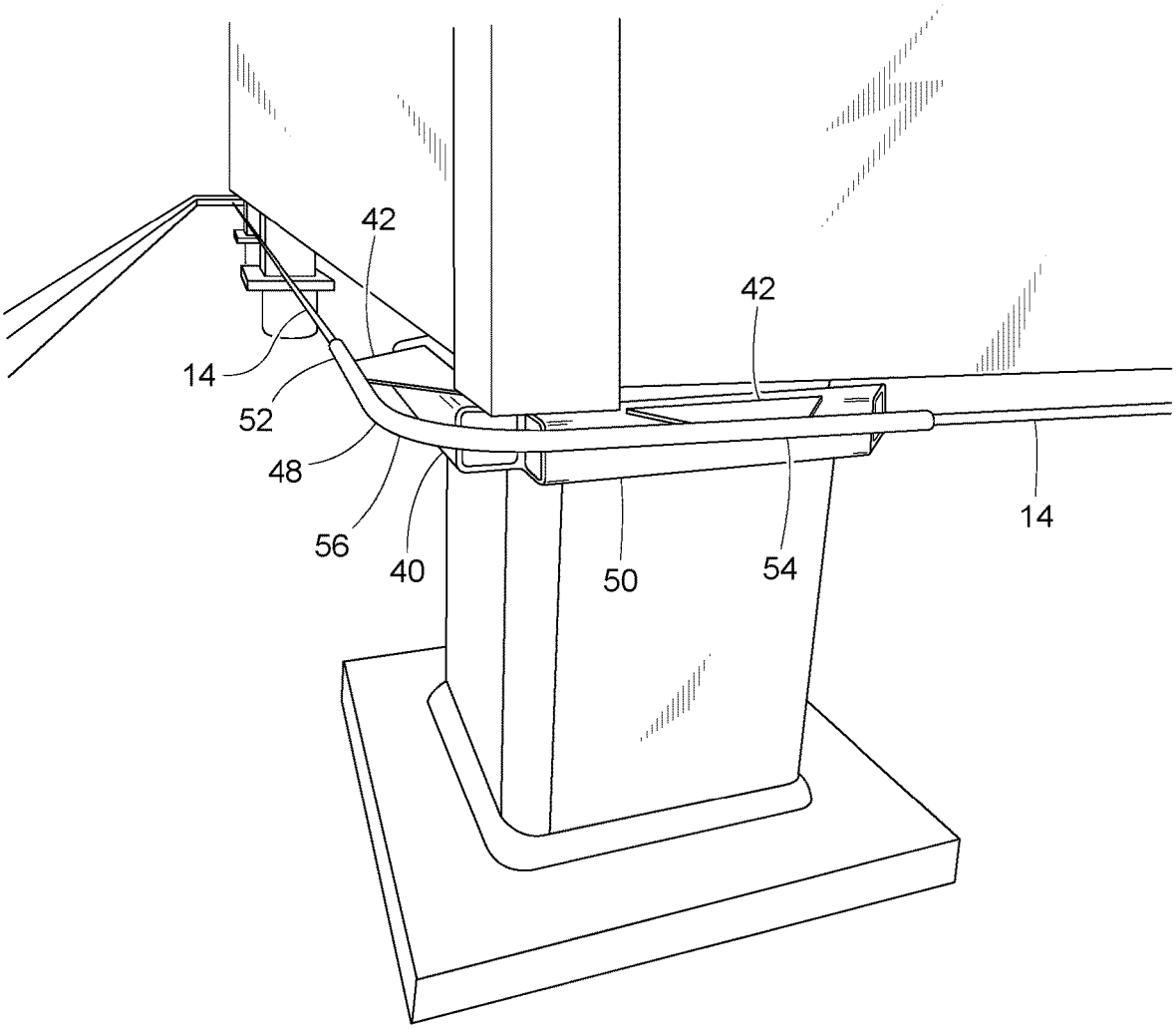
FIG. 9 shows an embodiment of an anchor.

FIG. 9 shows another embodiment of an anchor 40 arranged to support a cable 14. In some embodiments, an anchor 40 comprises a frame 50 arranged to be supported by a supporting structure. In some embodiments, the frame 50 supports a body portion 42 arranged to support the cable engaging portion 48. In some embodiments, the cable engaging portion 48 comprises a tube comprising a first length portion 52 and a second length portion 54. In some embodiments, the first length portion 52 is oriented at an angle to the second length portion 54. In some embodiments, the first length portion 52 is straight and the second length portion 54 is straight. In some embodiments, the first length portion 52 is attached to the second length portion 54 via a curved portion 56.

Figure 10:
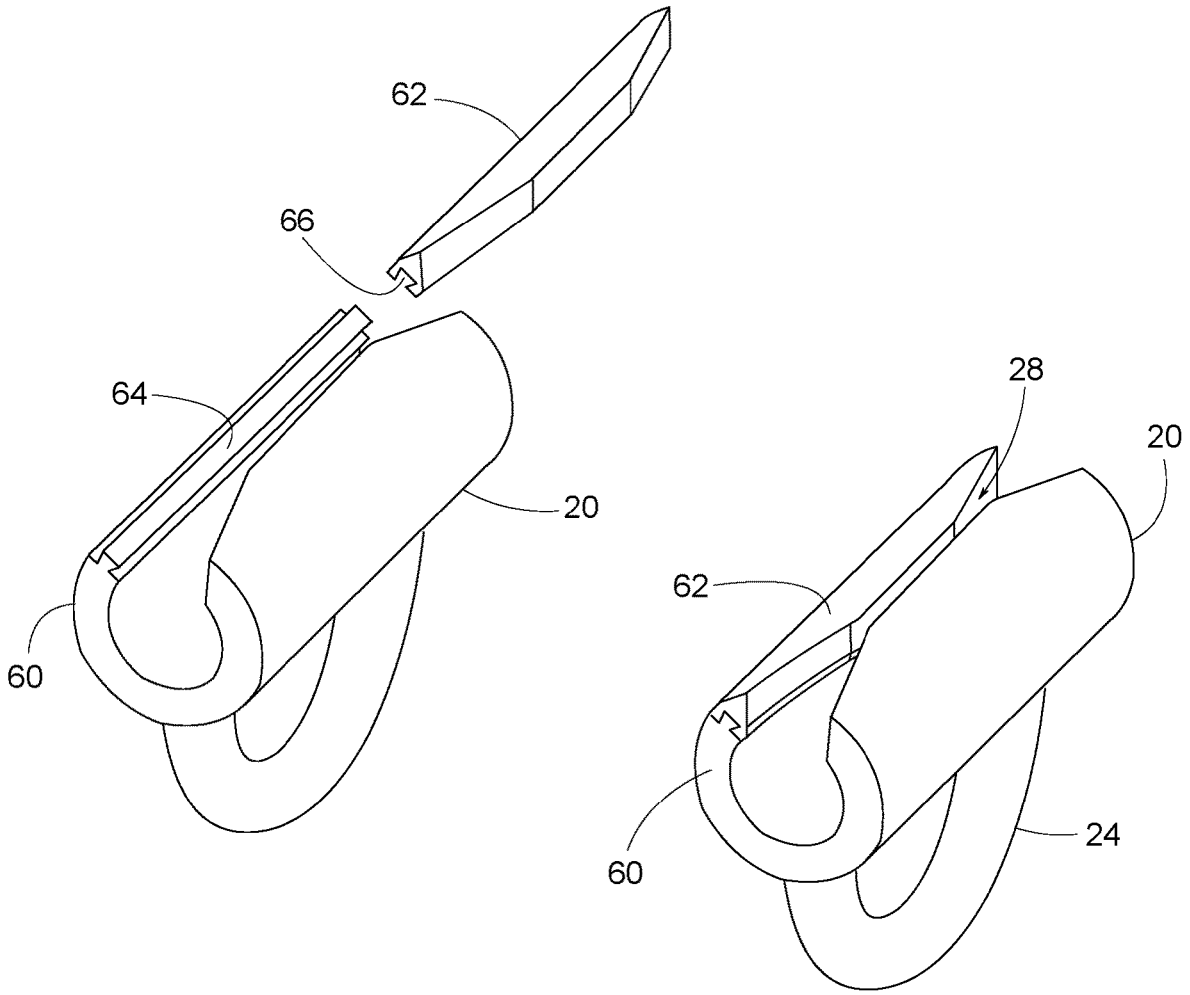
FIG. 10 shows an embodiment of a shuttle.

FIG. 10 shows another embodiment of a shuttle 20. In some embodiments, a shuttle 20 comprises a first portion 60 moveable with respect to a second portion 62. In some embodiments, the slot 28 is defined by the first portion 60 and the second portion 62. In some embodiments, the first portion 60 can be moved with respect to the second portion to vary the size of the slot 28.

In some embodiments, the first portion 60 comprises a dovetail protrusion 64 and the second portion 62 comprises a dovetail slot 66.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A lifeline comprising:

an anchor arranged to support a cable, the anchor comprising a body portion and a cable engaging portion, the body portion comprising a thickness, the cable engaging portion comprising a first length portion and a second length portion, the first length portion oriented at a non-zero angle to the second length portion; and a shuttle arranged to move along a length of the cable, the shuttle comprising a first end and a second end, a cavity extending from the first end to the second end, and a slot extending from the first end to the second end;

the cable extending through the cavity, a width of the slot being greater than the thickness of the body portion, the width being less than a cross-sectional size of the cable;

the shuttle comprising a first portion moveable with respect to a second portion to change a size of the slot, the first portion comprising a dovetail protrusion, the second portion comprising a dovetail slot engaged with the dovetail protrusion.

2. The lifeline of claim 1 comprising an orientation wherein the body portion is oriented in the slot.

3. The lifeline of claim 1, the body portion comprising a plate.

4. The lifeline of claim 1, the slot comprising flared end portions.

5. The lifeline of claim 1, the shuttle comprising a cylindrical shape.

6. The lifeline of claim 1, the shuttle comprising a hoop.

7. The lifeline of claim 6, wherein the hoop is aligned on a first radial vector and the slot is aligned on a second radial vector.

8. The lifeline of claim 7, wherein an angle between the first radial vector and the second radial vector is 90 degrees.

9. The lifeline of claim 1, the shuttle comprising a wall thickness, the wall thickness being greater than a distance across the slot.

10. A lifeline comprising:

an anchor arranged to support a cable, the anchor comprising a body portion and a cable engaging portion, the body portion comprising a thickness; and a shuttle arranged to move along a length of the cable, the shuttle comprising a first end and a second end, a cavity extending from the first end to the second end, and a slot extending from the first end to the second end;

the cable extending through the cavity, a width of the slot being greater than the thickness of the body portion, the width being less than a cross-sectional size of the cable;

the cable engaging portion comprising a tube, the cable extending continuously through the tube;

the shuttle comprising a first portion moveable with respect to a second portion to change a size of the slot, the first portion comprising a dovetail protrusion, the second portion comprising a dovetail slot engaged with the dovetail protrusion.

11. The lifeline of claim 10, comprising an orientation wherein the tube is oriented in the cavity.

12. The lifeline of claim 10, the tube comprising curvature along its length.

13. The lifeline of claim 10, the tube comprising a first length portion and a second length portion, the first length portion oriented at a non-zero angle to the second length portion.

14. The lifeline of claim 13, the first length portion oriented perpendicular to the second length portion.

15. The lifeline of claim 13, the anchor comprising a first plate and a second plate, the first plate contacting the first length portion and the second plate contacting the second length portion.

16. A lifeline comprising:

an anchor arranged to support a cable, the anchor comprising a body portion and a cable engaging portion, the body portion comprising a thickness; and a shuttle arranged to move along a length of the cable, the shuttle comprising a first end and a second end, a hoop, a cavity extending from the first end to the second end, and a slot extending from the first end to the second end;

the cable extending through the cavity, a width of the slot being greater than the thickness of the body portion, the width being less than a cross-sectional size of the cable;

wherein the hoop is aligned on a first radial vector and the slot is aligned on a second radial vector and an angle between the first radial vector and the second radial vector is 180 degrees;

the shuttle comprising a first portion moveable with respect to a second portion to change a size of the slot, the first portion comprising a dovetail protrusion, the second portion comprising a dovetail slot engaged with the dovetail protrusion.

* * * * *